US005547280A

United States Patent [19]

Wanninger et al.

[11] Patent Number: 5,547,280

[45] Date of Patent: Aug. 20, 1996

[54] MAGNETIC STIRRER WITH A SEALED GLASS HOUSING

[75] Inventors: Alfred Wanninger, deceased, late of Heitersheim, by Hanna M. Wanninger, heiress; by Peter Wanninger, heir, Staufen, both of Germany

[73] Assignee: Janke & Kunkel GmbH & Co. KG IKA-Labortechnik, Staufen, Germany

[21] Appl. No.: 394,971

[22] Filed: Feb. 27, 1995

[30] Foreign Application Priority Data

Feb. 25, 1994 [DE] Germany ..... 44 06 217.6

[51] Int. Cl.[6] ..... B01F 13/08

[52] U.S. Cl. ..... 366/274

[58] Field of Search ..... 366/273, 274, 366/347, 349, 601; 422/99, 104; 416/3

[56] References Cited

U.S. PATENT DOCUMENTS

| | | | |
|---|---|---|---|
| 2,350,534 | 6/1944 | Rosinger | 366/274 |
| 2,655,354 | 10/1953 | Murray | 416/3 X |
| 2,958,517 | 11/1960 | Harker et al. | 422/104 X |
| 3,116,913 | 1/1964 | Lane | 416/3 X |
| 3,138,370 | 6/1964 | Anderson et al. | 366/274 |
| 3,384,353 | 5/1968 | Worth | 366/274 |
| 3,554,497 | 1/1971 | Zipperer | 366/274 X |
| 4,162,855 | 7/1979 | Bender | 366/274 |

FOREIGN PATENT DOCUMENTS

| | | | |
|---|---|---|---|
| 7041043 | 2/1971 | Germany . | |
| 3402041 | 11/1991 | Germany . | |
| 63-151342 | 6/1988 | Japan | 366/273 |
| 1629081 | 2/1991 | U.S.S.R. | 366/274 |

*Primary Examiner*—Charles E. Cooley

*Attorney, Agent, or Firm*—Panitch Schwarze Jacobs & Nadel, P.C.

[57] ABSTRACT

A magnetic stirrer (1) has a two-part housing (2), wherein the lower part (3) contains a drive motor (5) and its controlling, while the upper part (4) forms the mounting surface for a stirring container that holds the stirring magnet, and wherein the separating surface of the two parts (3) and (4) runs approximately horizontal when in the working position. The upper part (4) of this housing (2) is made of glass and the edge (8) of this upper part (4), when in its working position, is tightly pressed against an opposing surface (9) of the lower part (3), and is possibly even bonded thereto. The edge (8) can have a widening (10) that engages into a corresponding undercut (11) of the lower part (3). This provides a very simple and economical design for the magnetic stirrer (1), but one which is nevertheless also tightly sealed and impervious to aggressive vapors.

18 Claims, 2 Drawing Sheets

MAGNETIC STIRRER WITH A SEALED GLASS HOUSING

FIELD OF THE INVENTION

The invention pertains to a magnetic stirrer with a housing that has a lower part and an upper part connectable with it, wherein the drive motor with its controlling means and the electrical connection are placed in the lower part, and the upper part can be placed on top of the lower part and forms with its top side the mounting surface for a stirring container that holds the stirring magnet.

BACKGROUND OF THE INVENTION

Magnetic stirrers of this type are already known in practice. Since as a rule they do not contain any heating, the upper part of the housing can at the same time be the mounting surface for the stirring container. As a rule, the housing upper part is made of plastic, so that in the case of an aggressive medium to be stirred, there exists the danger that this upper part can be damaged by overflowing ingredients or substances, or even by aggressive vapors that are released during stirring. If the container has been wetted on the outside with the aggressive medium that is to be stirred, the contact surface is exposed to this medium for a corresponding length of time, and as a result can, in some cases, become irreparably damaged.

Attempts have already been made, therefore, to make use of an enameled upper part which still has the disadvantage that it is sensitive to impacts and requires an expensive manufacturing process. In addition to that, with all of these known solutions there exists a sealing problem between the upper and lower parts, wherein the seal is, as a rule, created by as close a fit as possible between the lower part and the upper part, and possibly by means of a labyrinth seal that is provided in conjunction therewith. As a result, an aggressive vaporized medium can make its way into the interior of the device.

A further solution provides for an upper part made of stainless steel, wherein sealing problems also arise and, in the case of highly aggressive media, the danger of corrosion exists in spite of the construction material being used. Furthermore, such a device is very expensive because of the material used.

SUMMARY OF THE INVENTION

The object therefore exists of creating a magnetic stirrer of the type mentioned at the beginning, in which the mounting surface is largely impervious to aggressive media, liquids in particular but also including vapors, and in spite of that can be manufactured economically and allows for a simple and effective seal with respect to the lower part.

The solution to this object lies in the upper part of the housing being made of glass, and the edges of this upper part being pressed against the lower part in a self-sealing manner.

Glass is a strong enough construction material to be used as the mounting surface for the stirring container which, as a rule, is also made of glass and can withstand aggressive media just like the stirring container made of glass. In addition, such a glass upper part can be manufactured economically, particularly since glass is an inexpensive material.

Moreover, the edge of this glass upper part, which is to be joined with the lower part, can be formed in such a way and made so smooth that a sufficient seal results automatically when it is pressed onto the lower part.

In conjunction with this, it is especially beneficial if the lower part of the device is made of a construction material that is elastically somewhat flexible. As a result, when the upper part is pressed on, the opposite surface adapts itself to it, even if slight dimensional deviations exist, so that the sealing action is improved.

An especially good seal is provided if the glass upper part is configured with a cupped or bowl-like shape and, when in the working position, has at its lower, free, circumferential edge a bead, flange, or similar kind of widening, and if on the lower part a seat is provided that has an undercut for receiving this widening.

In conjunction with this, the seat for the edge can be sunk within the lower part so that a sealing surface is provided both at the face of the edge of the glass part, as well as at the widening, and ultimately over a part of the height of the side surface of the glass upper part.

Since the lower part is made of a somewhat flexible construction material, the glass upper part can be pressed against its seat from above, even though the widening is somewhat over-sized with respect to the topmost opening of the lower part. When in its working position, the upper opening of the lower part should lie under pressure against the outside of the glass upper part. In this way there is provided a sealing seat along the joining line between the lower part and the upper part that is impenetrable even for vapors.

The side wall of the glass upper part can have a recess for the passing through of a control knob shaft so that the device can be altered from the outside, for example with respect to the motor speed. In conjunction with that, it is beneficial if the control knob bearing support is itself provided on the lower part and protrudes far enough beyond the upper part so that the recess for the rotating shaft is covered and is likewise closed off at the outside of the upper part.

The control knob with its attached shaft can be interlocked with its outer edge at the control knob bearing support of the lower part in such a way that it can rotate. This can be achieved in an especially easy way if the control knob bearing support of the lower part has a circumferential groove, and the control knob has a circumferential edge or bead that fits into the groove and can be fitted into the groove. Since the groove and the bead rotate in a circle, the control knob can be turned to change the motor speed in spite of this interlocking.

It should also be mentioned that the use of glass has the advantage that the upper part can be configured in such a way that it is transparent, and thus makes it possible for the user to make a visual check of the motor that is located in its interior. There is also the possibility, however, of coating this upper part, and in particular on the inside, so as to provide a coating in the sealed space and thus separated from aggressive media. This has the advantage that through the use of such a coating, and depending on the use of colors, graphics and patterns, the device can be configured in an optically differentiated and appealing manner, and even lettering, the brand name or instructions for example, can be applied which are well protected and easily visible.

An additional advantage of the glass upper part resides in the fact that in the event of damage or destruction it could be very easily and economically replaced by a new upper part of the same type, especially since the assembly is also very simple.

In order that the glass upper part cannot be accidentally pulled from its sealing seat or fall out, it can be bonded to the lower part. As a result, the seal can be further improved, although it then has to be taken into account that a replacement of the upper part becomes more difficult. If the device can no longer be repaired, the glass upper part has the advantage of being easy to recycle.

The shaft of the control knob can be coupled with an adjustable potentiometer, the changing of which changes the speed of the motor. If the rotating shaft is turned too far, the potentiometer, which has only a limited permissible angle of rotation, could be torn from its mounting. On the one hand, this can be detected through the glass cover, and on the other, a configuration of the rotating knob is possible in which a limit-stop is provided on its rotation path that limits its rotation path to the maximum angle of rotation of the potentiometer.

In order to compensate for assembly and manufacturing tolerances, the rotating shaft can be made thin or weak in such a way that upon a limit-stop contact within the potentiometer and before a limit-stop contact of the control knob at its rotation limit, a torsion is allowed and thereby a reaching of the control knob limit-stop before the mounting of the potentiometer is overloaded.

Overall, there results, primarily as a result of the combination of individual or groups of the above-described features and measures, a high-performance magnetic stirrer that is small in its dimensions, is highly resistant to chemicals, can be manufactured in a simple and economic way as a result of the slight engineering effort, requires few individual pieces, and can be highly reliable overall.

BRIEF DESCRIPTION OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF PREFERRED EMBODIMENTS

Figure 1:
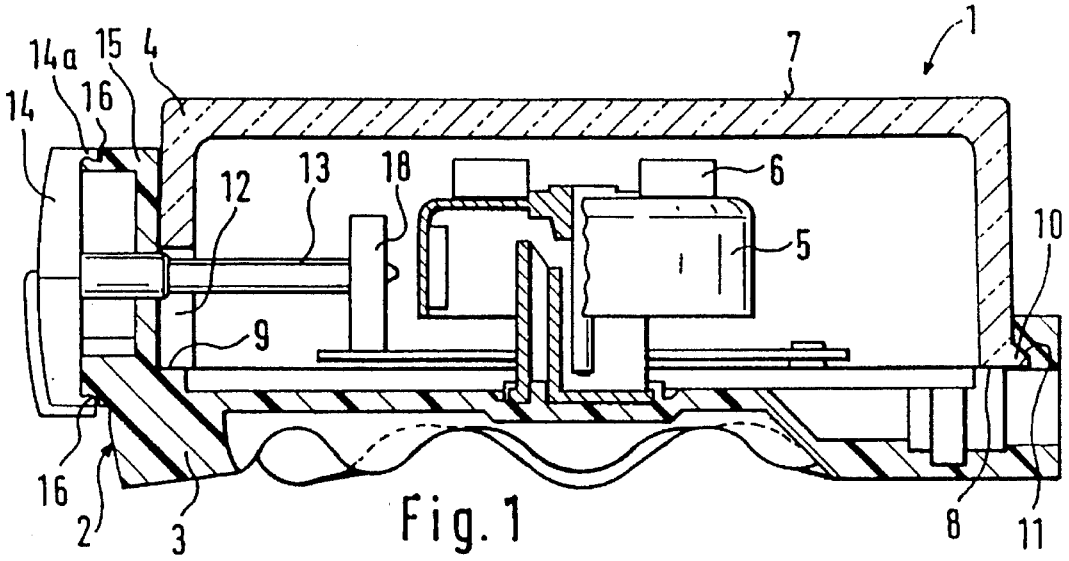
FIG. 1 is a vertical section through a magnetic stirrer in accordance with the invention with a two-part housing.

A magnetic stirrer that is identified in its entirety by 1 has a housing 2, which is made up of two parts, namely a lower part 3 and an upper part 4. In the lower part 3 are placed a drive motor 5 with controlling means and the like and with the electrical connection as well. This drive motor 5 has magnets 6 by means of which a stirring magnet (not shown) can be placed into corresponding rotation in a stirring container. The upper part 4 is secured to the lower part 3, and the upper side 7 of this upper part 4 is the mounting surface for a stirring container that holds the stirring magnets and that is often made of glass.

The upper part 4 of this magnetic stirrer 1 is made of glass as well, and its edges are pressed in a self-sealing manner against the lower part 3 of the housing 2 in a way that is described below. Primarily in FIG. 1 can be seen that the edge 8 of the glass upper part 4, which is to be joined to the lower part 3, is so smooth that a good sealing effect is created just through pressing it against a corresponding opposite surface 9 of the lower part 3.

In conjunction with that, the lower part 3 can be made of a somewhat elastically flexible construction material, such as plastic or synthetic rubber, so that the edge 8 and the opposing surface 9 can adapt even to mutual, slight dimensional deviations when they are pressed together, and as a result, the above-mentioned sealing effect is created.

In FIG. 1 it can be seen that the glass upper part 4 is configured with a cupped or bowl-like shape, whereby the "bottom" of this "bowl" when in the working position is pointing upward and forms the mounting surface 7. When in this working position, the lower, free, circumferential edge 8 exhibits a widening 10, somewhat in the shape of a flange which, with respect to the outside of the upper part 4, protrudes radially to the outside.

In the region of the opposing surface 9, the lower part 3 has a ring-like circumferential undercut 11 which, when in the working position, receives the above-mentioned widening 10 in a positive-fit (formfit) manner. In conjunction with that, the opposing surface 9 is sunk within the lower part 3 as the seat for the edge 8, so that sealing surfaces are provided both at the edge 8 of the glass upper part 4, as well as at the widening, and also as at the outside of the upper part 4 adjacent to this widening. In this way there are created in practice several ring-like sealing surfaces adjacent to one another that prevent the entry of aggressive vapors into the interior of the magnetic stirrer 1.

If in addition the lower part 3 is made of a flexible construction material, the glass upper part 4 can be pressed into its working position from above and engaged with its widening 10 in the undercut 11, even though this widening is somewhat over-sized in comparison to the actual upper opening of the lower part 3. In this way, the opening of the lower part 3 is under pressure at the outside of the upper part 4 when in the working position, and brings about the sealing seat that is impenetrable for vapors along the contact surfaces between the lower part 3 and the upper part 4.

In accordance with FIG. 1, the side wall of the upper part 4 has a recess 12 for the entry of a control knob shaft 13, which in FIG. 4 is shown again separately along with the control knob 14. By means of this control knob 14, via the control knob shaft 13, the magnetic stirrer 1 can be altered from the outside, for example with respect to its motor speed. In this regard, the control knob bearing support 15 is itself provided on the lower part 3, which can be seen in FIGS. 1 and 3. This control knob bearing support 15 thus stands high and protruding with respect to the lower part, and thus along side of the upper part 4, to the extent that the recess 12 provided there for the control knob shaft 13 is covered and, with the corresponding position against the outside of the upper part 4, is sealed as well. This protruding and contacting of the control knob bearing support 15 against the outside of the upper part 4 can be seen primarily in FIG. 1, but also in FIG. 2, where the matching of this control knob bearing support 15 to the contour of the upper part 4, circular in the embodiment shown, can be seen.

In accordance with FIG. 1, the control knob 14 with the control knob shaft 13 fastened to it rotatably interlocks with its outer edge **14*a* at the control knob bearing support 15 of the lower part 3 of the housing 2. This represents a very simple type of assembly. In conjunction with this, in accordance with FIG. 4, the actual control knob shaft 13 is in turn inserted into a corresponding seat of the control knob 14 and fixed in position either by clamping or by bonding, so that the shaft 13 itself can be made of metal, but the control knob 14** can be made of plastic.

For the interlocking, the control knob bearing support 15 has a circumferential groove 16 and the control knob 14 has a circumferential edge **14*a* or bead that fits into the groove 16 and engages with the groove 16. This provides for a very simple assembly and a simple disassembly as well. Since the groove 16 and edge or bead 14*a* run in a circle, the control knob 14 with its central control knob shaft 13** can be rotated in spite of this interlocking for the purpose of, for example, changing the motor speed.

The connection between the upper part 4 and the lower part 3 can be further improved if these parts are bonded to one another. At the same time, the seal would also be improved by this means.

Figure 2:
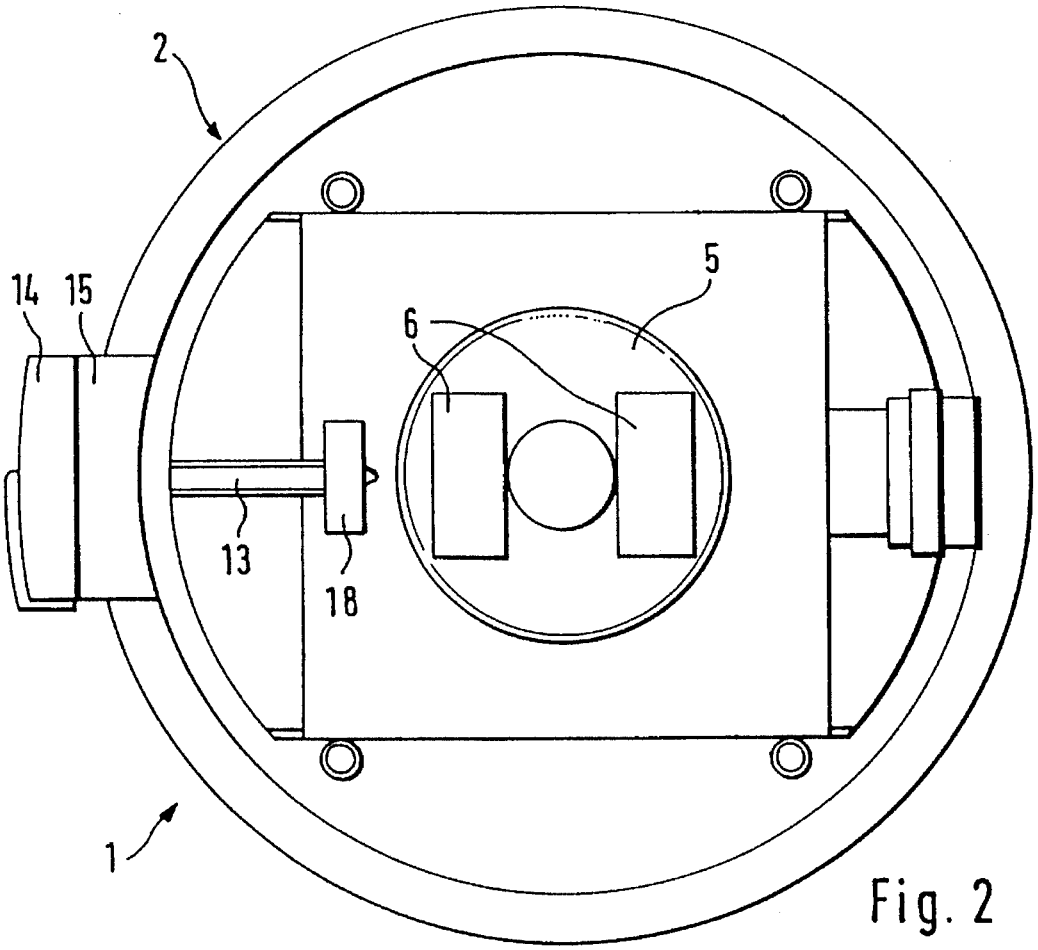
FIG. 2 is a top view of this magnetic stirrer.
Figure 3:
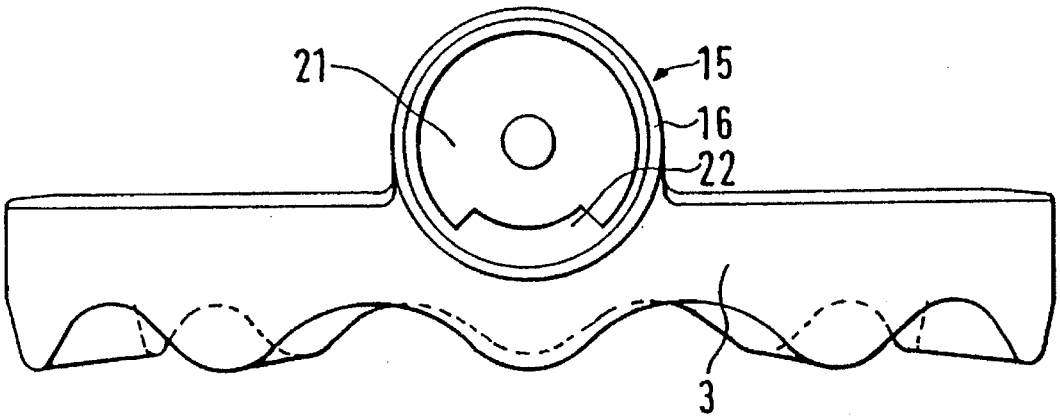
FIG. 3 is a broken away side view of the lower part of the magnetic stirrer with the bearing support for a control knob for adjusting the motor speed.
Figure 4:
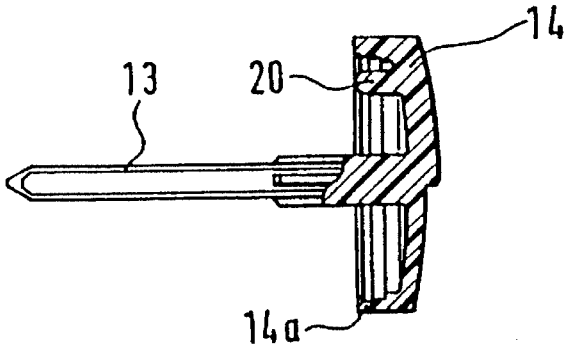
FIG. 4 is a longitudinal section of the control knob.
Figure 5:
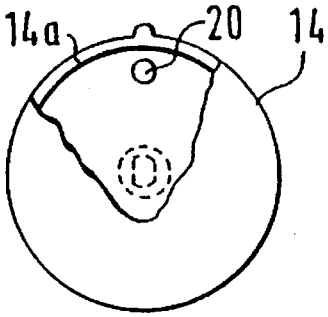
FIG. 5 is a front view of this control knob, partially broken away.

In accordance with FIGS. 1 and 2, the shaft 13 of the control knob 14 is coupled with an adjustable potentiometer 18, the change of which brings about a corresponding change in the speed of the motor. If in this regard the control knob shaft 13 were to be turned too far, the potentiometer 18, which has only a limited permissible angle of rotation, could be damaged or torn from its mounting. The user is able to monitor this easily, however, since the upper part 4 is made of glass and can thus be transparent. However, in the embodiment described, an additional safeguard against such damage is provided by virtue of the fact that, for the control knob 14, there is provided in its path of rotation a limit stop 20 that limits this path of rotation to the maximum permissible angle of rotation of the potentiometer 18. This limit stop 20 can be seen as an interior projection in the control knob in FIGS. 4 and 5. It projects into a corresponding cutout 21 in the control knob bearing support 15, and limits the predetermined angle to approximately 270° in either direction. In FIG. 3 this cutout, which extends around the major portion of the circumference of the control knob bearing support 15, can be easily seen as a limit stop projection 22 that projects into this cutout.

It will be appreciated by those skilled in the art that changes could be made to the embodiment described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A magnetic stirrer (1) comprising a housing (2) having a lower part (3) and an upper part (4) connectable with the lower part, a drive motor (5) with controlling means for controlling the drive motor, an electrical connection for the drive motor and a drive magnet (6), drivingly attached to the drive motor, located in the lower part (3) of the housing (2), the upper part (4) forming on its top side a mounting surface (7) for a stirring container that holds a stirring magnet, the upper part (4) being made of glass and having a cupped or bowl shape with a lower, free, circumferential edge (8) pressed against an opposing surface (9) of the lower part (3), the lower, free, circumferential edge (8) having a widening (10), and the opposing surface (9) forming a seat having an undercut (11) for receiving the widening (10) in a self-sealing manner.

2. The magnetic stirrer in accordance with claim 1, wherein in a working position of the stirrer, the edge (8) and the opposing surface (9) are arranged in a plane that is horizontal and parallel to the mounting surface (7).

3. The magnetic stirrer in accordance with claim 1, wherein the edge (8) has a form and smoothness effective to result in an automatic seal when pressed against the lower part (4) in a working position of the stirrer.

4. The magnetic stirrer in accordance with claim 1, wherein the lower part (4) is made of a somewhat elastically flexible material.

5. The magnetic stirrer in accordance with claim 4, wherein the material is selected from the group consisting of plastic and synthetic rubber.

6. The magnetic stirrer in accordance with claim 4, wherein the upper part (4) is pressed from above through the flexible material of the lower part (3) against the seat formed by the opposing surface (9).

7. The magnetic stirrer in accordance with claim 1, wherein the opposing surface (9) is recessed within the lower part and provides a sealing surface at an outer side of the glass upper part (4) adjacent to the widening (10).

8. The magnetic stirrer in accordance with claim 1, wherein a side wall of the upper part (4) has a recess (12) for receiving a control knob shaft (13) of the controlling means for controlling the motor from outside the stirrer.

9. The magnetic stirrer in accordance with claim 8, further comprising a control knob bearing support (15) provided on the lower part (3) and projecting sufficiently over the upper part (4) that the recess (12) is covered and the upper part (4) is sealed.

10. The magnetic stirrer in accordance with claim 1, wherein an inside surface of the upper part exhibits an optically differentiated coating.

11. The magnetic stirrer in accordance with claim 1, wherein the upper part (4) is adhesively joined with the lower part (3).

12. The magnetic stirrer in accordance with claim 1, wherein the controlling means further comprises a control knob shaft (13) coupled with an adjustable potentiometer (18) and a control knob (14), and a limit stop (20) provided on a path of rotation of the control knob (14) that limits a maximum permissible angle of rotation of the potentiometer (18).

13. The magnetic stirrer in accordance with claim 12, wherein the control knob shaft (13) is made sufficiently thin or weak that at and before reaching the limit stop (20) the shaft (13) can itself be elastically deformed so that the control knob strikes against the limit stop (20) before the potentiometer (18) is overloaded on its mounting.

14. The magnetic stirrer in accordance with claim 1 wherein the widening (10) is selected from the group consisting of a bead or a radially outwardly protruding flange.

15. A magnetic stirrer (1) comprising a housing (2) having a lower part (3) and an upper part (4) connectable with the lower part, a drive motor (5) with controlling means for controlling the drive motor, an electrical connection for the drive motor and a drive magnet (6), drivingly attached to the drive motor, located in the lower part (3) of the housing (2), the upper part (4) forming on its top side a mounting surface (7) for a stirring container that holds a stirring magnet, the upper part (4) being made of glass and having an edge (8) pressed against an opposing surface (9) of the lower part (3) in a self-sealing manner, a side wall of the upper part (4) having a recess (12) for receiving a control knob shaft (13) of the controlling means for controlling the motor from outside the stirrer, and a control knob bearing support (15) being provided on the lower part (3) and projecting sufficiently over the upper part (4) such that the recess (12) is covered and the upper part (4) is sealed.

16. The magnetic stirrer in accordance with claim 15, further comprising a control knob (14) having an outer edge (14*a*) which rotatably interlocks with the control knob bearing support (15).

17. The magnetic stirrer in accordance with claim 16, wherein the control knob bearing support (15) has a circumferential groove (16) and the outer edge (14*a*) interlocks with the groove (16).

18. A magnetic stirrer (1) comprising a housing (2) having a lower part (3) and an upper part (4) connectable with the lower part, a drive motor (5) with controlling means for controlling the drive motor, an electrical connection for the drive motor and a drive magnet (6), drivingly attached to the drive motor, located in the lower part (3) of the housing (2), the upper part (4) forming on its top side a mounting surface (7) for a stirring container that holds a stirring magnet, the upper part (4) being made of glass and having an edge (8) pressed against an opposing surface (9) of the lower part (3) in a self-sealing manner, the controlling means including a control knob shaft (13) coupled with an adjustable potentiometer (18) and a control knob (14), and a limit stop (20) provided on a path of rotation of control knob (14) that limits a maximum permissible angle of rotation of the potentiometer (18), the control knob shaft (13) being made sufficiently thin or weak that at and before reaching the limit stop (20) the shaft (13) can itself be elastically deformed so that the control knob strikes against limit stop (20) before the potentiometer (18) is overloaded on its mounting.

* * * * *